US005621992A

United States Patent [19]

Mandell et al.

[11] Patent Number: 5,621,992

[45] Date of Patent: Apr. 22, 1997

[54] FOUR SIDED COLLAPSIBLE FLOOR SIGN

[75] Inventors: Jonathan N. Mandell, Hattiesburg, Miss.; Glenn E. Tomblin, Winchester, Va.

[73] Assignee: Rubbermaid Commercial Products, Inc., Winchester, Va.

[21] Appl. No.: 421,519

[22] Filed: Apr. 13, 1995

[51] Int. Cl.[6] ..... G09F 15/00

[52] U.S. Cl. ..... 40/610; 40/539; 116/63 P

[58] Field of Search ..... 40/610, 606, 539; 116/63 D, 63 T, 63 C; 248/166; 256/64; 229/113; 404/6

[56] References Cited

U.S. PATENT DOCUMENTS

| | | | |
|---|---|---|---|
| D. 257,720 | 12/1980 | Rockman | D10/109 |
| D. 328,615 | 8/1992 | Taylor | D20/19 |
| 824,126 | 6/1906 | Little | 40/610 |
| 2,047,748 | 7/1936 | Schmidt | 116/63 C |
| 3,195,255 | 7/1965 | Toulmin, Jr. | 116/63 P |
| 3,880,406 | 4/1975 | Stehle et al. | 256/64 |
| 3,971,331 | 7/1976 | Sawyer | 116/63 |
| 4,253,260 | 3/1981 | Maza et al. | 40/610 |
| 4,541,190 | 9/1985 | Weiner et al. | 40/610 |
| 4,624,210 | 11/1986 | Glass | 116/63 |
| 4,859,983 | 8/1989 | Kulp et al. | 340/908.1 |
| 4,974,815 | 12/1990 | Glass | 256/64 |
| 5,003,912 | 4/1991 | Thurston | 116/63 |
| 5,009,541 | 4/1991 | Thurston | 404/6 |
| 5,046,885 | 9/1991 | Thurston | 404/10 |
| 5,090,349 | 2/1992 | Wilson | 116/63 C |

OTHER PUBLICATIONS

Sell sheet, Floor signs; Geerpres, P.O. Box 658, Muskegon, Michigan 49443. Publication date 1987.

P. 39, Floor signs; Lab Safety Supply, address unknown. Published at least as early as Jul., 1994.

Sell sheet, Floor signs; Lamba Systems, A Division of American Allsafe Company, Tonawanda, NY 14150. Published at least as early as Nov., 1993.

Sell sheet, Floor signs; A.R.P. Safety Products, P.O. Box 7048–A, St. Louis, Missouri 63177. Published at least as early as Jul., 1994.

Pp. 37 and 38, Floor signs; Lab Safety Supply, address unknown. Published at least as early as 1994.

P. 3, Floor signs; Sanitary Maintenance Safety Products, address unknown. Published at least as early as 1995.

*Primary Examiner*—Kenneth J. Dorner
*Assistant Examiner*—Cassandra Davis
*Attorney, Agent, or Firm*—Richard B. O'Planick; Lisa B. Riedesel

[57] ABSTRACT

A self standing floor sign (10) comprising two end panels (12 and 14), and two side panels (16), the two side panels (16) pivotably secured between the end panels (12 and 14), and the side panels (16) having a hinge oriented within an approximate center of the side panels (16) to allow the side panels (16) to collapse in a generally inwardly direction.

11 Claims, 9 Drawing Sheets

FOUR SIDED COLLAPSIBLE FLOOR SIGN

FIELD OF THE INVENTION

The subject invention relates generally to the field of floor signs, and more particularly to four sided collapsible self-standing plastic floor signs.

THE PRIOR ART

The use of self-standing plastic floor signs in connection with conveying various messages and warnings is well known in the art. Typically such floor signs are two sided, self-standing and collapsible as illustrated in U.S. Pat. No. 4,253,260 entitled "Self-Standing Floor Sign", filed Oct. 18, 1979, the teachings and FIGS. 1–12 of which are hereby incorporated by reference FIGS. 9 and 10, which were originally FIGS. 5 and 6 of the '260 patent, illustrate the hinge core portions 31 and 32. The cores are adapted to fit rotatably in the tubular hinge portions 24. In order to accomplish radial insertion of the cores 31 and 31 through slots 27 and 28, the cores are provided with laterally directed U-shaped notches 31' and 32', which extend through the cores. The cores 31 and 32 are inserted into slots 27 and 28 sufficiently to allow the corners 31" and 32" to snap past the edges of the slots 27 and 28.

Prior to the invention of the collapsible four sided floor sign disclosed in the present invention, a number of problems existed with the prior art floor signs. Specifically, the floor signs had a limited amount of space in which to convey messages or warnings, since they only consisted of two panels. In addition, the prior art floor signs did not contain the ability to easily attach various types of additional barricading means such as chains or ropes directly to a floor sign, thereby allowing a barricading means to be easily disposed between two floor signs or between one floor sign and another object. Finally, while some prior art floor signs do contain four sides, they are not easily collapsible by the user. Since floor signs are often used by a variety of people in a variety of locations, it is desirable that a floor sign be easily collapsible and easy to set up in a variety of locations by a variety of users.

SUMMARY OF THE INVENTION

The improved four sided collapsible plastic floor sign overcomes the disadvantages in the prior art by providing a floor sign which has an increased message conveying space, and has the ability to easily collapse. The floor sign contains four panels, namely a front, rear and two side panels. The front and rear panels may be hingedly secured together as disclosed in U.S. Pat. No. 4,253,260, or a variety of other ways. Each of the side panels may consist of a first and a second member which are hingedly secured together along an edge of each of the side members. The hingedly secured first and second members are subsequently hingedly secured between the front and rear panels, such that the side panels may collapse in a generally inwardly direction. In addition, the front and rear panels of the collapsible floor sign contain attaching means for securing an additional barricading rope or chain between any two floor signs or between a floor sign and another object.

Accordingly, it is an object of the present invention to provide an improved self standing floor sign which includes four panels.

Another object of the present invention is to provide a four sided floor sign which is collapsible.

A further object of the present invention is to provide a floor sign which has attaching means for securing a barricading rope or cable between two like floor signs.

A still further object of the present invention is to provide for a floor sign which has an improved hinge construction disposed in the side panels, which allows the side panels to easily collapse in a generally inwardly direction.

These and other objectives, which will be apparent to those skilled in the art, are achieved by a preferred embodiment which is described in detail below, and which is illustrated by the accompanying drawings.

DESCRIPTION OF THE PREFERRED EMBODIMENT

Figure 1:
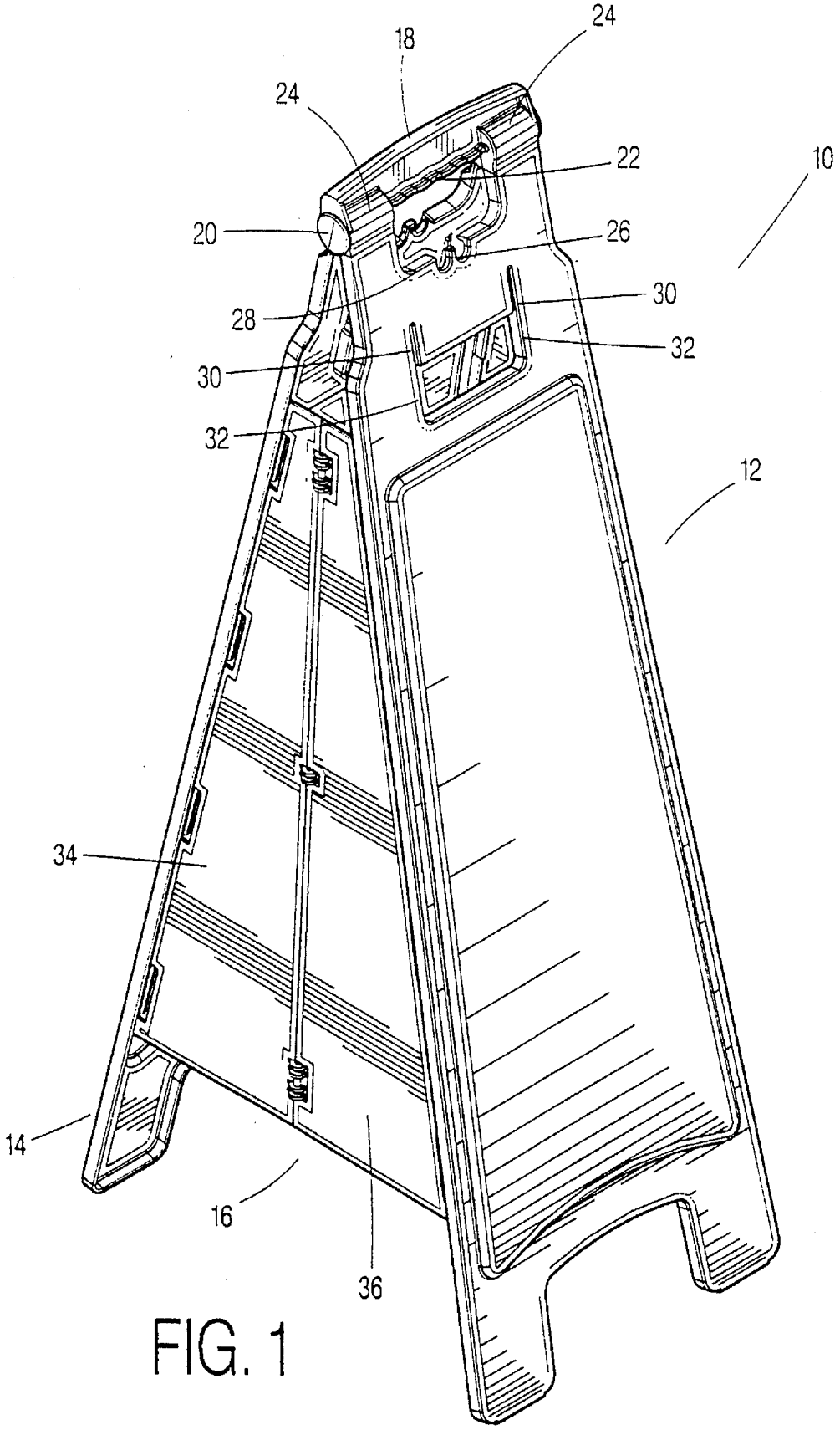
FIG. 1 is a front perspective view of the subject four sided collapsible floor sign in a spread apart position, in accordance with the present invention.
Figure 2:
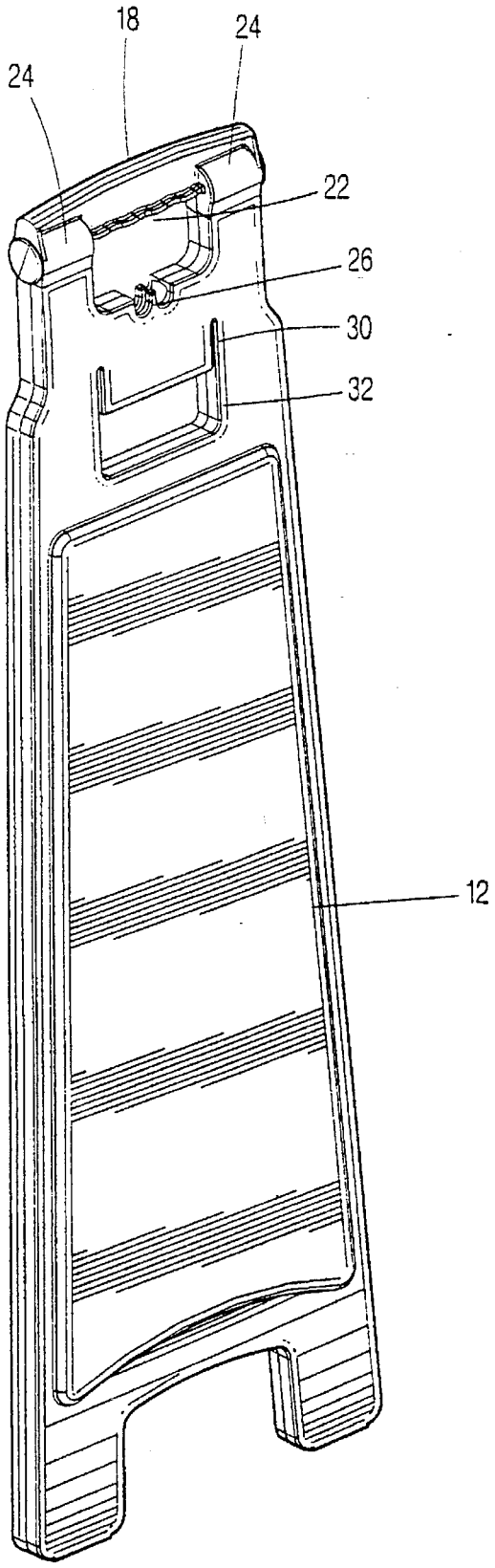
FIG. 2 is a front perspective view of the subject invention in a collapsed position.

A perspective view of an improved collapsible floor sign namely a four sided collapsible floor sign 10 in an open position is illustrated in FIG. 1. FIG. 2 illustrates the improved floor sign in a closed position, wherein the side panel members are collapsed in a generally inwardly direction. As illustrated more clearly in FIG. 1, a front panel member 12 is pivotably secured to a rear panel member 14 as described in U.S. Pat. No. 4,253,260, which is fully incorporated herein as reference. A variety of other securing means could also be used to secure together the front 12 and rear 14 panel members to provide for a floor sign which is collapsible.

In addition to the front 12 and rear 14 panel members the floor sign 10 also includes side panel members 16. The dimensions of the side panel members 16 assist in restricting the separation of the front 12 and rear 14 panels. Essentially, the side panels 16 act as a means for ensuring that the front 12 and rear 14 panels of the plastic floor sign 10 do not extend beyond the maximum free standing angle which is approximately 24°. In addition, existence of the side panels 16 decreases the necessity of a separate member extending between the front 12 and rear 14 panels for assisting in maintaining a correct distance between the from 12 and rear 14 panels, and increasing the stability of the floor sign 10. The floor sign 10 with side panels 16 provides for a floor sign which has an increase in stability, and an increase in space available for conveying messages to the public.

The side panels 16 may be secured to and disposed between the front 12 and rear 14 panels a variety of ways, which will be discussed later. The side panels 16 will be secured between the front 12 and rear 14 panels in such a way that the user can easily collapse and subsequently spread apart the floor sign 10, thereby allowing the floor sign 10 to be easily stored and moved from one location to another location.

The floor sign 10 can also be easily carried between locations by the user due to the shape of the crossbar 18, as illustrated in FIGS. 1 & 2. The crossbar 18 connects the tubular hinge portions 20, formed on the upper legs of the front panel 12. Specifically, the lower portion 22 of the crossbar 18 is generally shaped to conform with a user's fingers. The shape of the lower portion 22 of the crossbar 18 will increase the user's comfort, when the user attempts to lift and carry the floor sign 10. The curvature of the lower portion 22 of the crossbar 18 allows the user to easily carry the floor sign 10 long distances or for extended periods of time while maximizing the user's comfort.

Figure 3:
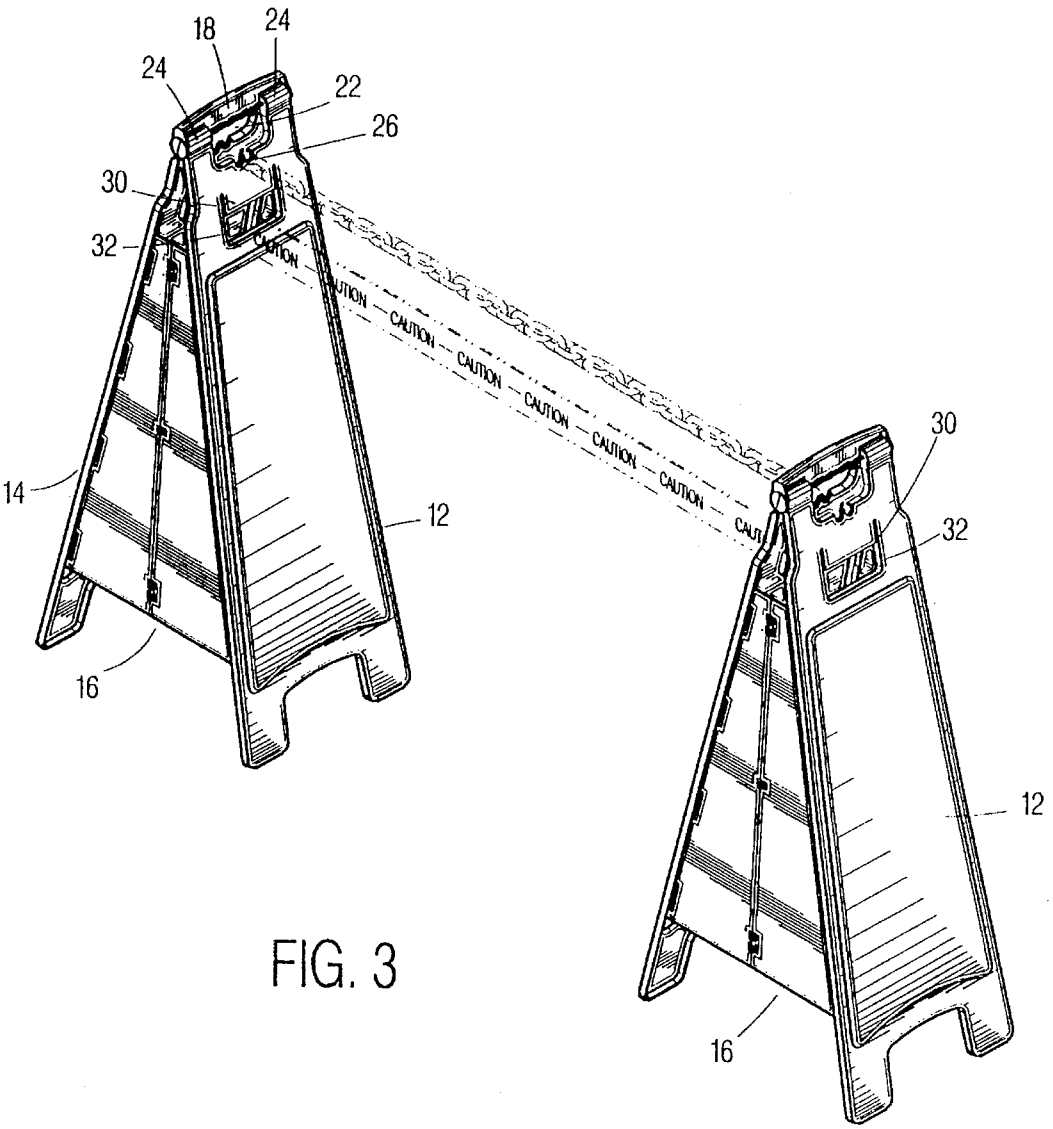
FIG. 3 is a front perspective view of the subject four sided collapsible floor sign and a similar like floor sign with barricading means secured to each of the two floor signs.

In order to further assist the users of floor signs 10, the front 12 and the rear 14 panel members may each include a variety of securing means which could assist in securing various types of barricading means to one of the floor signs 10 or between one floor sign 10 and another object, or assist in retaining the barricading means between two like floor signs 10. FIGS. 1 & 2 clearly illustrate securing means oriented adjacent a first generally rectangularly shaped recess 24 located adjacent an upper portion of both the front 12 and the rear 14 panels. A generally E shaped notch 26 is disposed approximately in the center of the bottom wall 28 of the generally rectangularly shaped recess. Although the recesses are shown as generally rectangular, the recesses may be of a variety of sizes and shapes. The generally E shaped notch 26 assists in receiving and retaining a barricading means such as a chain or rope. The lower portion 22 of the crossbar 18 acts essentially as the top wall of the generally rectangularly shaped recess. As illustrated in FIG. 3, barricading means such as a chain or rope may be disposed between two floor signs 10, or alternatively between one floor sign 10 and another object. The barricading means may be of a variety of types including a chains composed of various materials such as metal and plastic. In the event chain was used as a barricading means, one link of the chain may be secured over the center portion of the generally E shaped notch 26 on either one or both of the front 12 and rear 14 panels of each of the floor signs 10. Alternatively, separate barricading means or chains could be secured to each of the generally E shaped notches 26 on both the front 12 and rear 14 panels.

In addition to the generally E shaped notches 26 located on each of the front 12 and rear 14 panels, which allow for a barricading means to be secured to the floor sign, second securing means may also be located on either or both the front 12 and rear 14 panel members. A second generally rectangularly shaped recess is located approximately directly below the first generally rectangularly shaped recess. Narrow apertures 30 are located adjacent each of the side walls 32 of the second generally rectangularly shaped recess. The apertures 30 receive and retain barricading tape or cloth between any two floor signs 10 or one floor sign 10 and a stationary object. The second generally rectangularly shaped recess and the apertures 30 are sized such that barricading tape will easily be confined and retained in a generally upwardly position within the aperture 30, and be held adjacent to each of the side walls 32 of the second generally rectangularly shaped recess as illustrated in FIG. 3.

Figure 4:
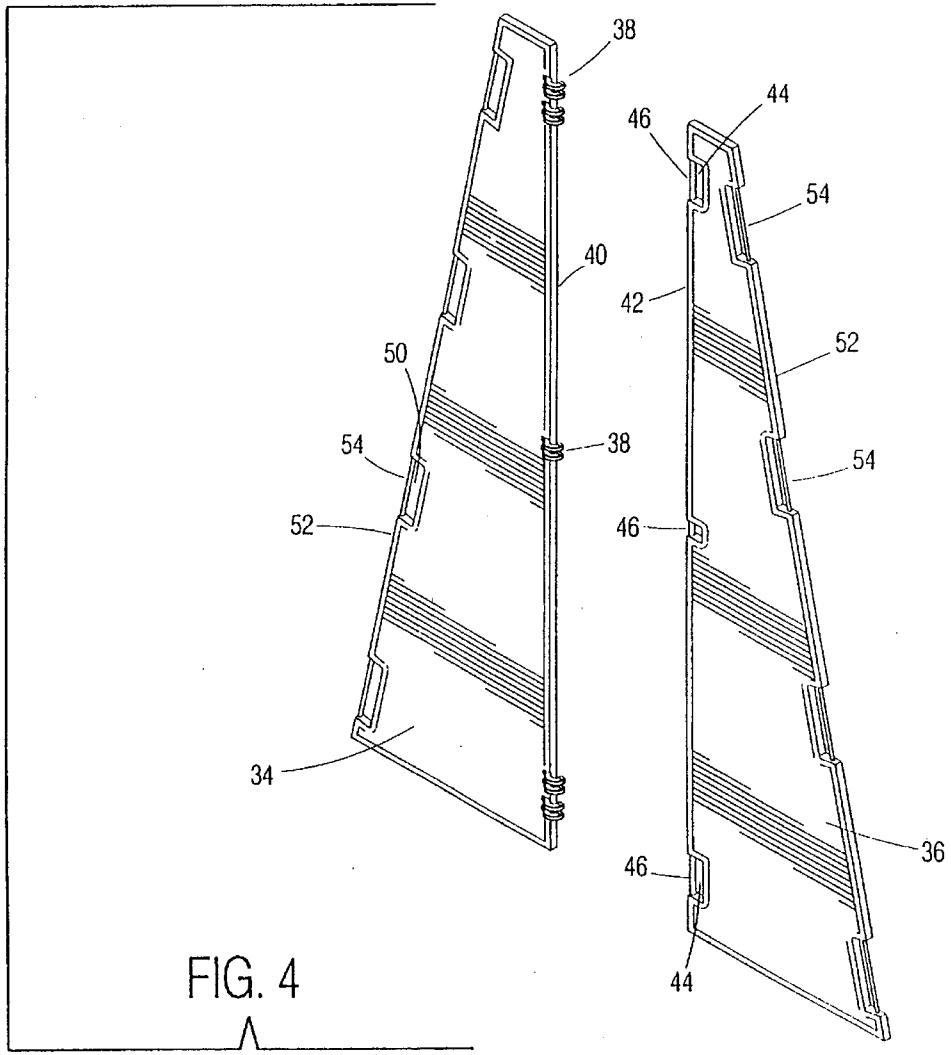
FIG. 4 is a front perspective view of the two members of the floor sign side panel as disclosed in the subject invention.

Each of the side panels 16 consist of preferably two members which allows each of the side panels 16 to collapse in a generally inwardly direction. Alternatively, each of the side panels 16 could also collapse in a generally outwardly direction. Specifically, as illustrated in FIG. 4, each of the side panels 16 is comprised of two members, namely a first member 34 and a second member 36. The first 34 and second 36 members are hingedly secured together such that each of the side panels 16 collapse in a generally inwardly direction to close the floor sign, as illustrated in FIG. 2. The collapsibility of the floor sign 10 allows the floor sign 10 to be easily stored when it is not in use, or easily carried when the user desires to move the floor sign 10 to a different location.

Figure 6:
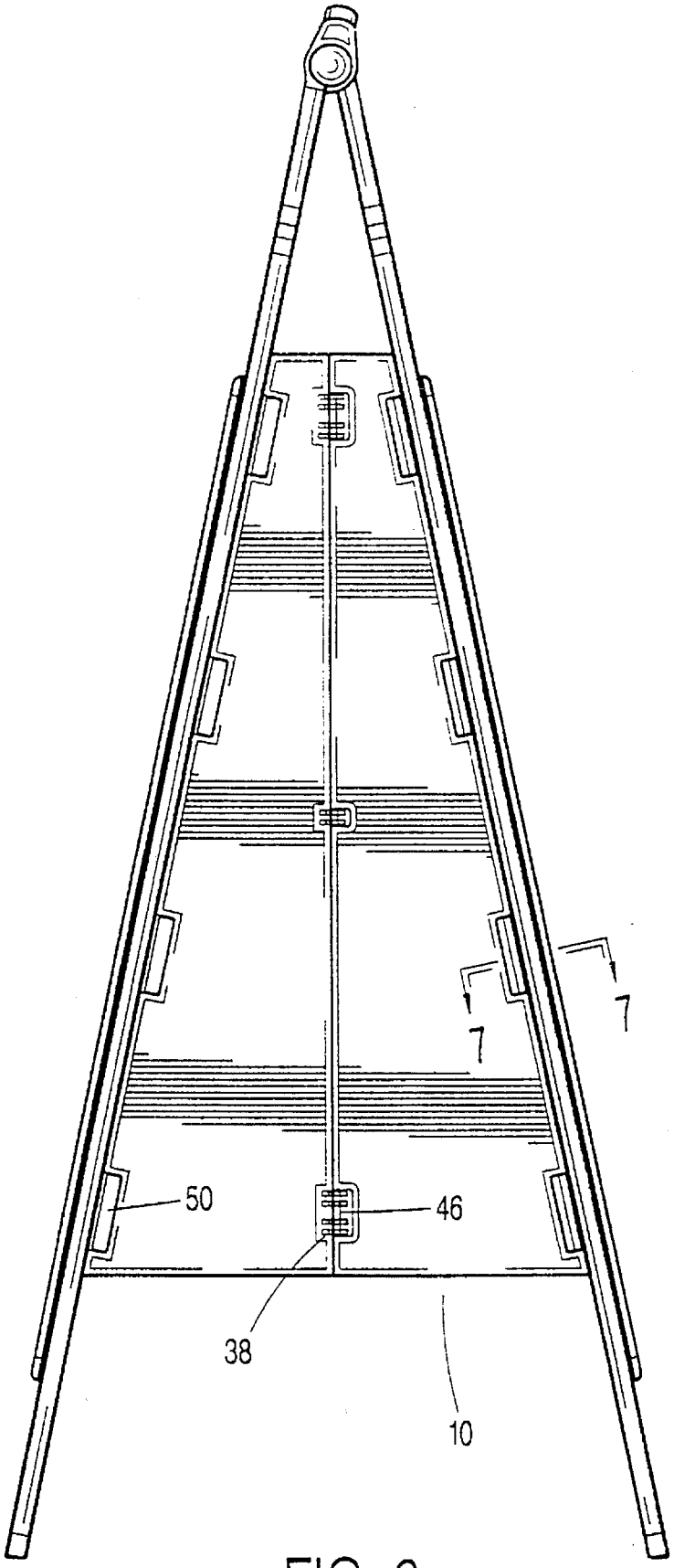
FIG. 6 is a side view of the subject invention in an open position.
Figure 8:
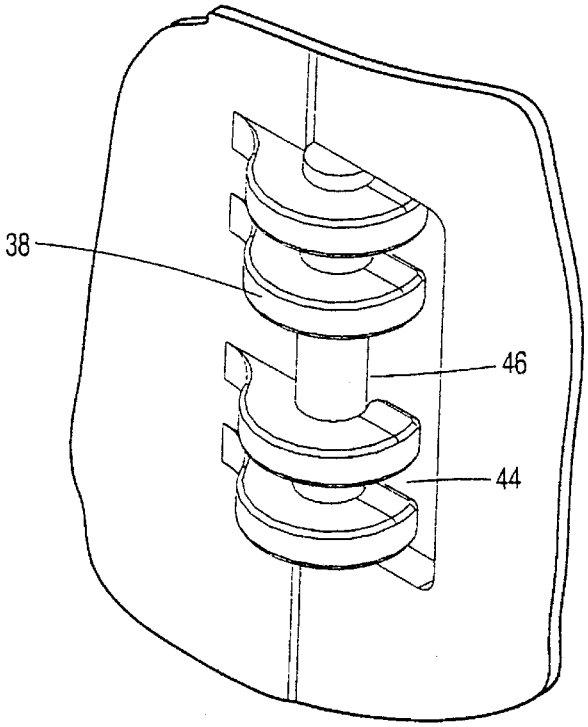
FIG. 8 is a partial enlarged view of the floor sign with sections broken away, illustrating the hinge connection between the two members of each side panel.
Figure 9:
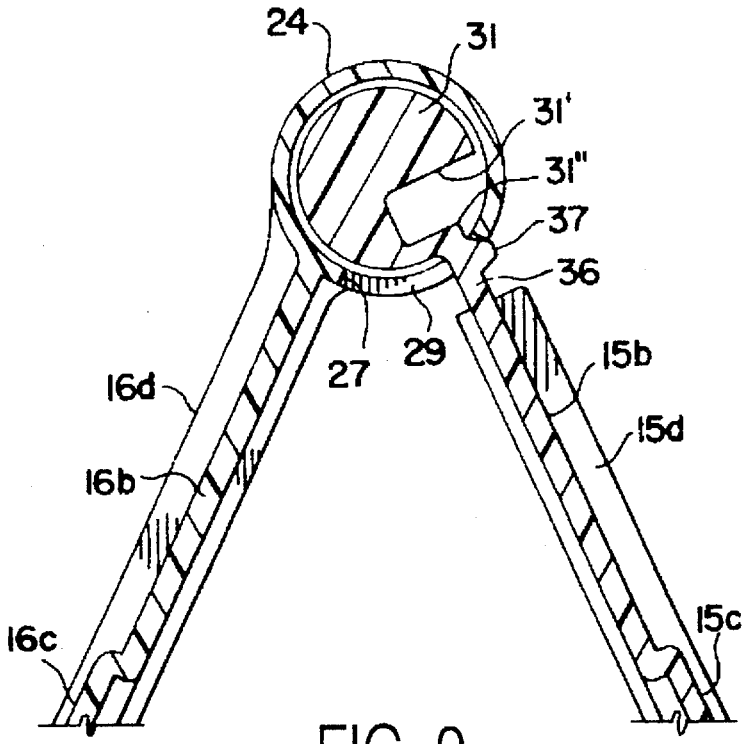
FIG. 9 PRIOR ART
FIG. 9 is a fragmentary sectional view of the upper hinge portion illustrated in the prior art patent U.S. Pat. No. 4,253,260.
Figure 10:
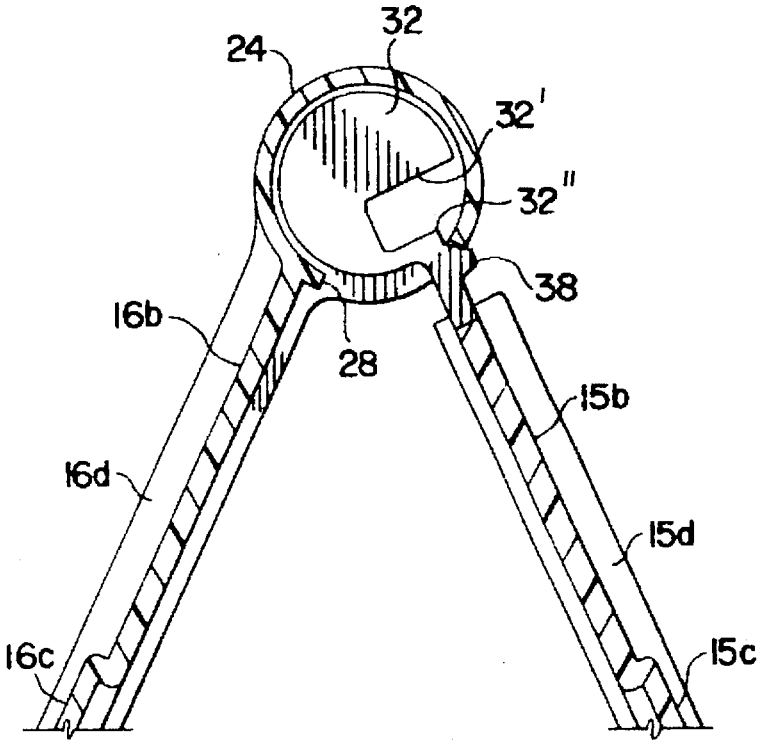
FIG. 10 PRIOR ART
FIG. 10 is a fragmentary sectional view of the upper hinge portion illustrated in the prior art patent U.S. Pat. No. 4,253,260.

The first 34 and second 36 members of each of the side panels 16 may be secured together by a variety of hinging means. FIGS. 4 & 8 illustrate hinging means used to secure the first 34 and second 36 members together. Specifically, the first member 34 of each of the side panels 16 contains generally C shaped fingers 38 which protrude in a generally outwardly direction along various locations adjacent an inner edge 40 of each of the first members 34. Adjacent the inner edge 42 of each of the second members 36 is at least one generally rectangularly shaped recess 44. FIG. 4 illustrates a second member 36 containing three generally rectangularly shaped recesses 44 oriented adjacent an approximately upper, lower and middle portion of the second member 36. Each of the recesses 44 are oriented approximately adjacent an inner edge 42 of the second member 36. The generally rectangularly shaped recesses 44 are positioned approximately adjacent an inner edge 42 of the second member 36, but the recesses 44 do not extend entirely to the inner edge 42. Rather, a narrow portion of the second member 36 remains, and essentially creates a pin member 46 which extends the length of each of the recesses 44, thereby creating an inner edge 42 for the second member 36. When the first 34 and second 36 members are oriented such that the inner edges 40 & 42 respectively, are adjacent to one another, the generally C shaped fingers 38, oriented adjacent the inner edge 40 of the first member 34, can easily engage the pin member 46 oriented adjacent the inner edge 42 of the second member 36, as illustrated in FIGS. 4 & 6. The securing means, specifically the generally C shaped fingers 38 conformed to grasp and secure the pin member 46 oriented adjacent an inner edge 42 of the second member 36, allows the first 34 and second 36 members of each of the side panels 16 to easily collapse in a generally inwardly direction when the user desires to collapse the floor sign 10. The generally C shaped fingers 38 can rotatably move over the circumference of the pin members 46, as the first 34 and second 36 members collapse in a generally inwardly direction.

Figure 5:
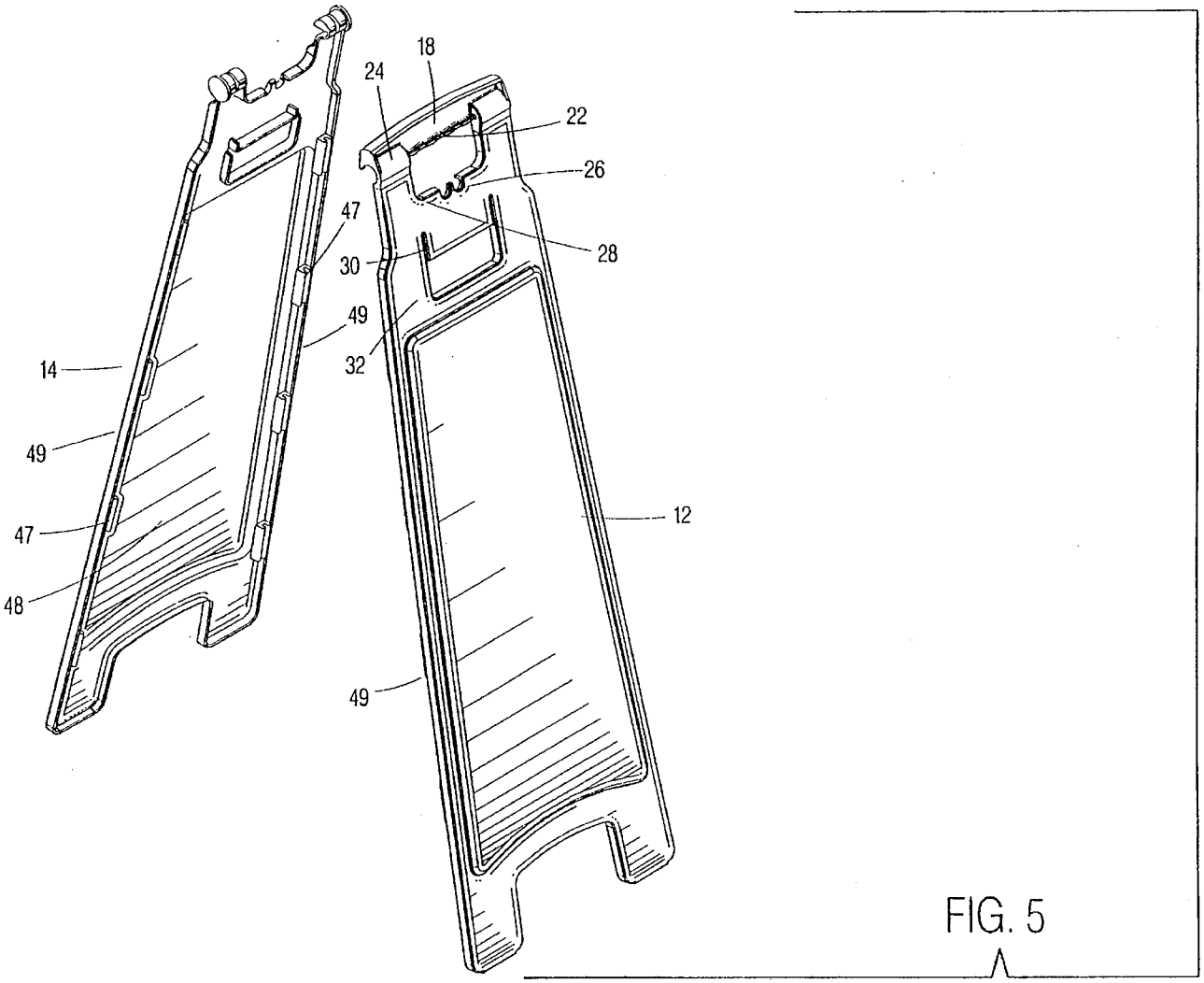
FIG. 5 is a front perspective view of the front and rear panels of the floor sign disclosed in the subject invention.
Figure 7:
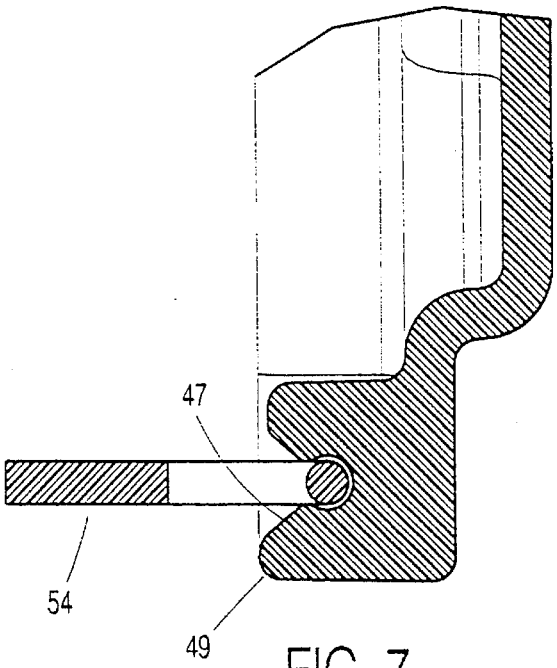
FIG. 7 is an enlarged partial cross sectional view along the lines 7—7 of FIG. 6.

The first 34 and second 36 members of each of the side panels 16 are also secured to each of the front 12 and rear 14 panels as illustrated in FIGS. 5–7. In order to ensure that the user can easily repeatedly collapse and extend the floor sign 10, the first 34 and second 36 members of each of the side panels 16 are pivotably secured to the front 12 and rear 14 panels. Specifically, FIGS. 5 & 7 illustrate generally C shaped channels 47 oriented adjacent an interior face 48 of each of the front 12 and rear 14 panels, approximately adjacent an outer edge 49. FIG. 5 illustrates four generally C shaped channels 47 oriented adjacent an outer edge 49 of the rear panel 14. However, any number of generally C shaped channels 47 can be oriented adjacent the outer edges 49 of the front 12 and rear 14 panels. The number of channels 47 should correspond to the number of pin members 54 on the first 34 and second 36 members.

Thus, when the front 12 and rear 14 panels of the floor sign 10 are separated by the maximum angle of separation, the generally C shaped channels 47 oriented adjacent both the outer edges 49 of the front panel 12 are generally aligned with the generally C shaped channels 47 oriented adjacent both the outer edges 49 of the rear panel 16. FIG. 4 illustrates generally rectangularly shaped recesses 50 oriented approximately adjacent the outer edges 52 of each of the first 34 and second 36 members of each of the side panels 16. The recesses 50 oriented adjacent the outer edges 52 of the first 34 and second 36 members are similar to the recesses 44 oriented adjacent the inner edge 42 of the second member 36. Since the recesses 50 do not extend entirely to the outer edge 52 of the first 34 and second 36 members, a portion of the first 34 and second 36 members creates a pin member 54 which extends the length of each of the recesses 50. The pin members 54 oriented adjacent the outer edges 52 of each of the first 34 and second 36 members of each of the side panels 16 may be pivotably secured by the generally C shaped channels 47 oriented adjacent an outer edge 49 of each of the front 12 and rear 14 panels. The pivotal connection between the generally C shaped channel 46 and the pin member 54 allows each of the side panels 16 to easily connect with the front 12 and rear 14 panels. The pivotal connection provides each of the pin members 54 with the ability to easily rotate within the generally C shaped channels 47, thereby providing the side panels 16 with the ability to easily collapse in a generally inwardly direction.

The floor sign 10 can be easily assembled by the user by assembling the front 12 and rear 14 panels according to U.S. Pat. No. 4,253,260. The first 34 and second 36 members may then be easily connected together by securing the generally C shaped fingers 38 over the pin members 46 oriented adjacent the inner edges 40 & 42, respectively. Each of the side panels 16, containing the first 34 and second 36 members, may subsequently be pivotably connected to the front 12 and rear 14 panels, thereby creating a floor sign 10 having four panels which easily collapsible.

While the above describes the preferred embodiment of the subject invention, the invention is not to be so restricted. Other embodiments which will be apparent to those skilled in the arts and which utilize the teachings herein set forth are intended to be within the scope and spirit of the subject invention.

We claim:

1. A self-standing all plastic floor sign comprising two end panels having an upper and lower end, said upper ends of said end panels hinged together for selectively folding and spreading said lower ends of said end panels apart, said end panels each having two outer edges, the improvement comprising:

securing means, disposed approximately adjacent said outer edges of each of said end panels, for assisting in securing a first and a second side panel to each of said end panels;

hinge means disposed within an approximate center of each of said first and said second side panels for allowing said side panels to collapse in a generally inwardly direction;

said side panels having two outer edges, and at least one pin member oriented adjacent each of said side panel outer edges;

each of said securing means comprising at least one generally C shaped channel oriented on an interior wall of said end panels and oriented approximately adjacent said outer edge of said end panels, said channel for mating with one of said corresponding pin members oriented adjacent said side panel outer edges.

2. A self-standing all plastic floor sign comprising two main panels having an upper and a lower portion, said upper portions of said main panels hinged together for selectively folding and spreading said main panel lower portions apart, one of said main panels having an integral tubular hinge portion at an upper end provided with a longitudinal slot, the other of said main panels having an integral core rotatable in said tubular hinge portion, said core having a laterally directed U-shaped notch adapted to allow said core to hook into and pass laterally through said slot into said tubular hinge portion by simultaneously rotating and pressing radially inward on said core to snap it past an upper edge of said slot, said improvement comprising:

two side panels having first hinge means integrally formed on outer edges of said side panels and pivoting means oriented within an approximate center of each of said side panels;

second hinge means integrally formed on said main panels, said second hinge means adapted to cooperate with said first hinge means to assist said pivoting means in permitting said side panels to be pivoted relative to each other between a collapsed position and an uncollapsed position.

3. A self-standing all plastic floor sign comprising two main panels having an upper and a lower end, said main panels hinged together at said upper ends for selectively folding and spreading said lower ends of said main panels apart, said improvement comprising:

two side panels being pivotably secured to each of said main panels;

said side panels each including a first and a second member first hinge means integrally formed on said first members, and second hinge means integrally formed on said second members, said first hinge means adapted to cooperate with said second hinge means to permit said first and said second members to be pivoted relative to each other between a collapsed position and an uncollapsed position.

4. A self-standing all plastic floor sign according to claim 3, each of said main panels further comprising an interior face having two edges and at least one receiving means oriented adjacent each of said interior face edges;

said receiving means for receiving corresponding pin means, said pin means oriented adjacent a first edge and a second edge of each of said side panels.

5. A self-standing all plastic floor sign according to claim 4, at least one of said main panels further comprising first securing means, disposed on at least one of said main panels, for assisting in securing barricading means to said floor sign.

6. A self-standing all plastic floor sign according to claim 5, said first securing means comprising a generally E shaped protrusion extending in a generally upwardly direction and oriented within an aperture in at least one of said main panels, said protrusion for assisting in securing barricading means to said floor sign.

7. A self-standing all plastic floor sign according to claim 6, at least one of said main panels further comprising second securing means, oriented approximately adjacent to said first securing means, for assisting in securing second barricading means to one of said main panels of said floor sign.

8. A self-standing all plastic floor sign according to claim 7, said second securing means comprising at least one opening oriented within a second aperture in at least one of said main panels, said opening for assisting in securing said second barricading means adjacent to at least one of said main panels.

9. A self-standing all plastic floor sign according to claim 4, said floor sign further comprising handle means disposed between said main panels, said handle means shaped to conform with a user's fingers.

10. A four sided all plastic collapsible floor sign, said sign comprising:

a front wall, rear wall, and two side walls, each of said side walls hingedly secured to said front and said rear wall;

hinge means interposed within an approximate center of each of said side walls for allowing said side walls to selectively collapse in a generally inwardly direction;

handle means oriented within said front wall and said rear wall, said handle being generally shaped to conform with a user's fingers;

first securing means oriented adjacent said handle means said first securing means for assisting in securing barricade means to said floor sign.

11. An improved self-standing floor sign comprising two end panels hinged together to pivot around a common axis of rotation, said improvement comprising:

two side panels, each of said side panels having at least two finger means oriented adjacent two outer edges;

said end panels each having at least two receiving means oriented adjacent two edges of an interior face of said end panels;

said receiving means and said finger means pivotably connecting said end panels and said side panels;

said end panels having handle means shaped to conform to a user's fingers;

first securing means, disposed on said end panels, for assisting in securing first barricading means to said end panels, said first securing means having a generally E shaped protrusion extending in a generally upwardly direction from a recess in said end panels;

second securing means, disposed on said end panels, for assisting in securing second barricading means to said end panels.

* * * * *